United States Patent [19]

Medina

[11] 3,972,185

[45] Aug. 3, 1976

[54] HYDRAULIC SYSTEM FOR A PIPELAYER

[75] Inventor: Glenn J. Medina, Joliet, Ill.

[73] Assignee: Caterpillar Tractor Co., Peoria, Ill.

[22] Filed: Feb. 28, 1975

[21] Appl. No.: 554,256

[52] U.S. Cl. ..... 60/421; 60/486; 91/412; 60/905

[51] Int. Cl.[2] ..... F15B 13/09

[58] Field of Search ..... 91/412; 60/420, 421, 60/425, 426, 427, 484, 486, 905

[56] References Cited

UNITED STATES PATENTS

| | | | |
|---|---|---|---|
| 2,643,516 | 6/1953 | Carlson | 60/421 X |
| 2,984,985 | 5/1961 | MacMillin | 60/471 X |
| 3,146,593 | 9/1964 | Stacey | 60/421 |
| 3,535,877 | 10/1970 | Becker et al. | 91/412 X |

*Primary Examiner*—Edgar W. Geoghegan
*Attorney, Agent, or Firm*—Phillips, Moore, Weissenberger, Lempio & Strabala

[57] ABSTRACT

A hydraulic system for pipelayers includes a first circuit with a pump and a motor for controlling a boom and a second pump and motor for controlling a hoist with pressure-responsive control means responsive to a first pressure for permitting combining of fluid for operation of the hoist and responsive to a second pressure for preventing combining of said fluid.

8 Claims, 2 Drawing Figures

10
32
13
27
28
26
31
20
19a
19b
19
30
17
21
16
25
22
23
15
24
29
33
18
34
36
14
35
11
25
12

54
43
48
61
39
58
59
60
62
50
49
42
41
56
68
57
47
52
53
55a
45
55
67
66
46
40
36
65
51
33
44
37
64
63
38
25
12
12

HYDRAULIC SYSTEM FOR A PIPELAYER

BACKGROUND OF THE INVENTION

The present invention relates to hydraulic systems and pertains particularly to a hydraulic control system for a pipelayer.

Vehicles having a boom and winch assembly specifically designed for lifting and handling sections of pipe and the like for construction and laying of pipe are normally referred to as pipelayers. Such pipelayers commonly employ a winch for controlling the position of a boom and a winch for controlling the raising and lowering of a load suspended from the boom. Hydraulical motors are commonly employed for powering the winches of the boom and the load-lift assembly. These winches are normally powered by separate hydraulic systems or circuits. However, since the boom is commonly maintained in a preselected position for an extended period of time, it is desirable that hydraulic power available for powering the boom winch may also be utilized for assisting in powering the hoist winch in order to increase the speed thereof.

Hydraulic systems having provision for combining fluid from separate pumps are known in the art. However, special considerations are required in hoist systems which are not present in a typical hydraulic circuit. For example, load-responsive control means are provided for reducing the speed of the hoist motor and increasing the torque thereof upon encountering the predetermined load. Such combining should also be such that it does not interfere with the operation of the other system. Some examples in the known prior art are as follows: U.S. Pat. No. 3,208,221 issued Sept. 28, 1965 to Schuetz; U.S. Pat. No. 3,800,669 issued Apr, 2, 1974 to Distler; and U.S. Pat. No. 3,815,478 issued June 11, 1974 to Axelesson et al.

While these patents disclose systems that are of interest, they do not suggest a satisfactory system for solving the problems set forth.

SUMMARY AND OBJECTS OF THE INVENTION

It is a primary object of the present invention to overcome the above problems of the prior art.

Another object of the present invention is to provide an improved and efficient hydraulic system for hydraulic pipelayers.

A further object of the present invention is to provide a hydraulic system for a pipelayer having means for combining the boom supply system with the hoist supply system for high-speed operation of the hoist when the boom is not in operation.

In accordance with the primary aspect of the present invention, a hydraulic power system for a pipelayer includes a first system for operating the boom and a second system for operating the hoist, with means provided for combining the fluid supply system for the boom with that of the hoist for providing high-speed operation of the hoist.

BRIEF DESCRIPTION OF THE DRAWINGS

The above and other objects and advantages of the present invention will become apparent from the following specification when read in conjunction with the drawings, wherein.

DETAILED DESCRIPTION OF PREFERRED EMBODIMENTS

Figure 1:
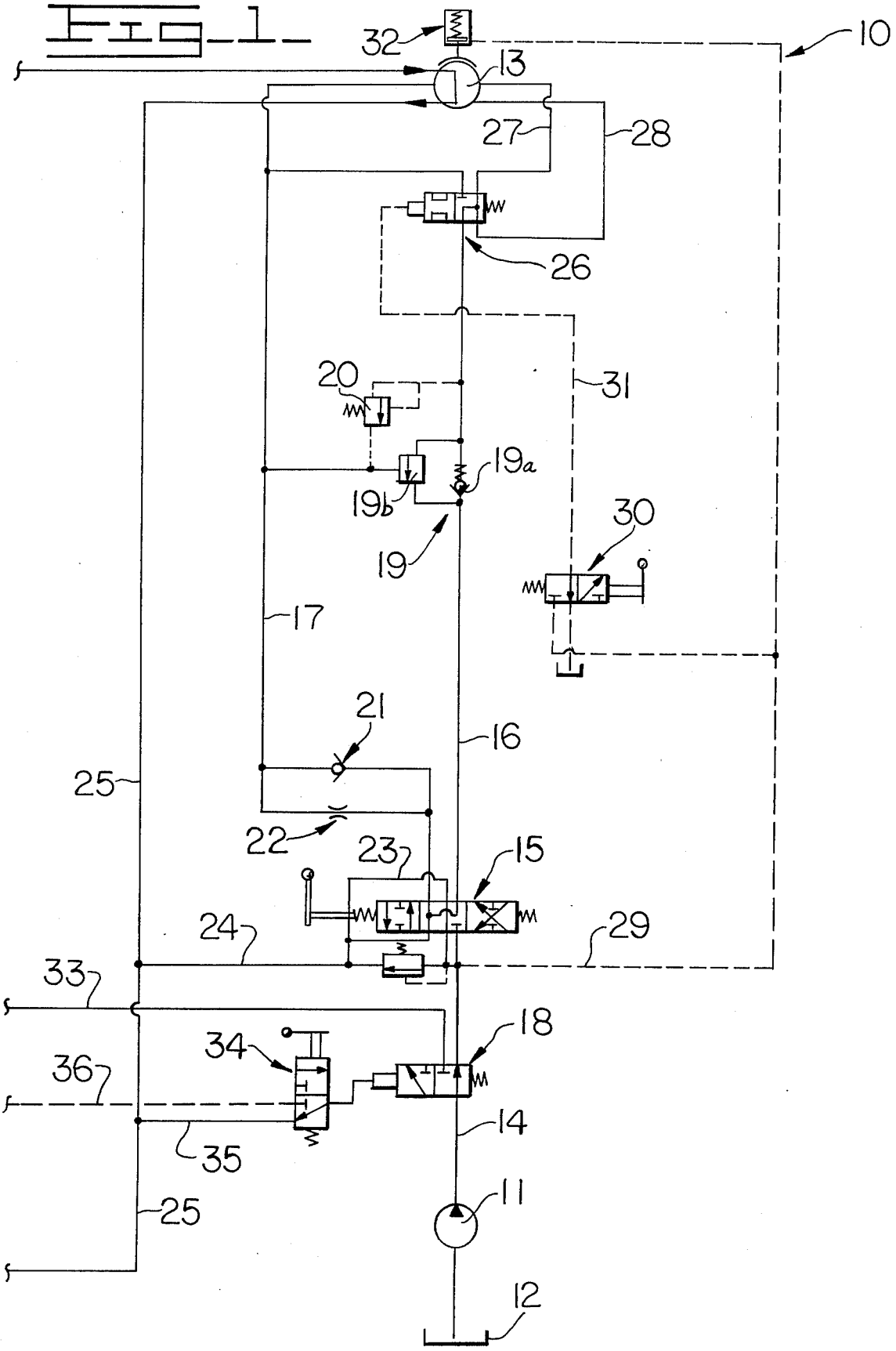
FIG. 1 is a schematic layout of the boom control portion of a hydraulic system for a pipelayer.

Turning now to FIG. 1 of the drawings there is illustrated the circuit for the boom control system. This circuit, generally designated by the numeral 10, comprises a pump 11 which draws fluid from a reservoir 12 and supplies it by way of the circuit for operation of a rotary hydraulic motor 13 for operation of the winch for controlling the position of the boom. The pump 11 supplies fluid by way of a first conduit 14 to a three-position main control valve 15 which is operative to selectively direct the fluid by way of either one of conduits 16 and 17 for operation of the motor 13. A pressure-responsive diverter valve 18 is disposed between the pump 11 and the main control valve 15 and is operative for diverting fluid from pump 11 to the other circuit for high-speed operation of the hoist winch as will be more particularly described later.

The conduit 16, which constitutes one of the main control motor control lines, includes a check and by-pass valve assembly indicated generally at 19. This assembly includes a check valve **19*a* operating as a non-return valve and a by-pass valve 19*b* for bypassing the valve 19*a* for permitting return fluid from motor 13. A damping valve 20 is also provided in the system for damping pressure fluctuations within the system when the brakes on the system are released. The motor control conduit 17 includes a check valve 21 which pemits free flow of fluid toward the motor 13 and a restriction 22 which restricts the flow of fluid from the motor 13** to maintain a back pressure on the pistons of the motor to prevent floating thereof and possible damage to the pistons or cams.

The main control valve 15 is a three-position valve having a central neutral position, with forward and reverse positions to either side of the central neutral position. The main control valve 15 is operative in the neutral position to permit fluid from inlet or supply conduit 14 to flow therethrough by way of a passage 23 to a return passage 24 and by way of a return line 25 to sump or tank 12. The valve 15 is operative in either one of the end positions to direct fluid by way of either one of the control conduits 16 or 17 for operation of motor 13 while at the same time communicating the other of the conduits 16 or 17 with the return passage 24 for return to tank 12.

A pilot-operated speed-control valve 26 is operative to direct fluid communicated thereto by way of conduit 16 to motor 13 by way of either one of a pair of passages 27 or 28 for high- or low-speed operation of the motor 13. When the fluid is communicated thereto by a single one of the passages, such as passage 28, the motor operates at high speed since the fluid is directed only to one-half the pistons of the motor 13. On the other hand, when fluid is communicated by way of both lines, as with the valve in its illustrated position, the motor 13 operates in its high-torque, low-speed operation.

The valve 26 is pilot-operated by pilot fluid from pilot line 29, which communicates pilot fluid from supply conduit 14 to a pilot control valve 30 for operation of the pilot valve 26. The pilot control valve 30 communicates fluid by way of conduit 31 for operation of the valve 26.

The pilot line 29 also communicates fluid to the brake system by means 32, which is normally spring-applied and pressure-released, for release of the brakes 32 upon an increase in pressure in line 29.

The diverter valve 18 is operative in the position as shown to permit fluid to flow therethrough to valve 15 for control of the boom circuit. The valve 18 is pilot-operated and is operated in its diverting position to divert fluid from pump 11 to conduit means 33 for communicating it to the hoist control circuit for combining with the fluid therein for high-speed operation of the hoist control circuit, as will be described. The diverter valve 18 is pilot-operated and controlled by means of the pilot control valve 34 which is operative in the position shown to vent the diverter valve 18 by way of vent line 35 to return line 25 to permit valve 18 to assume its neutral position as shown. The valve 34 is operative in its operative position to direct pilot fluid from a pilot line 36 to shift valve 18 to its right to communicate fluid from passage 14 to passage 33.

When the boom control circuit is not in operation, in other words, the boom itself is held stationary, the fluid from the boom supply pump 11 can be made available by means of the diverter valve 18 and conduit 33 for the hoist control circuit. This fluid is communicated by way of a conduit or line 33 which joins a supply line 37 from a pump 38 which supplies fluid for operation of the hoist control circuit which is generally designated by the numeral 39.

Figure 2:
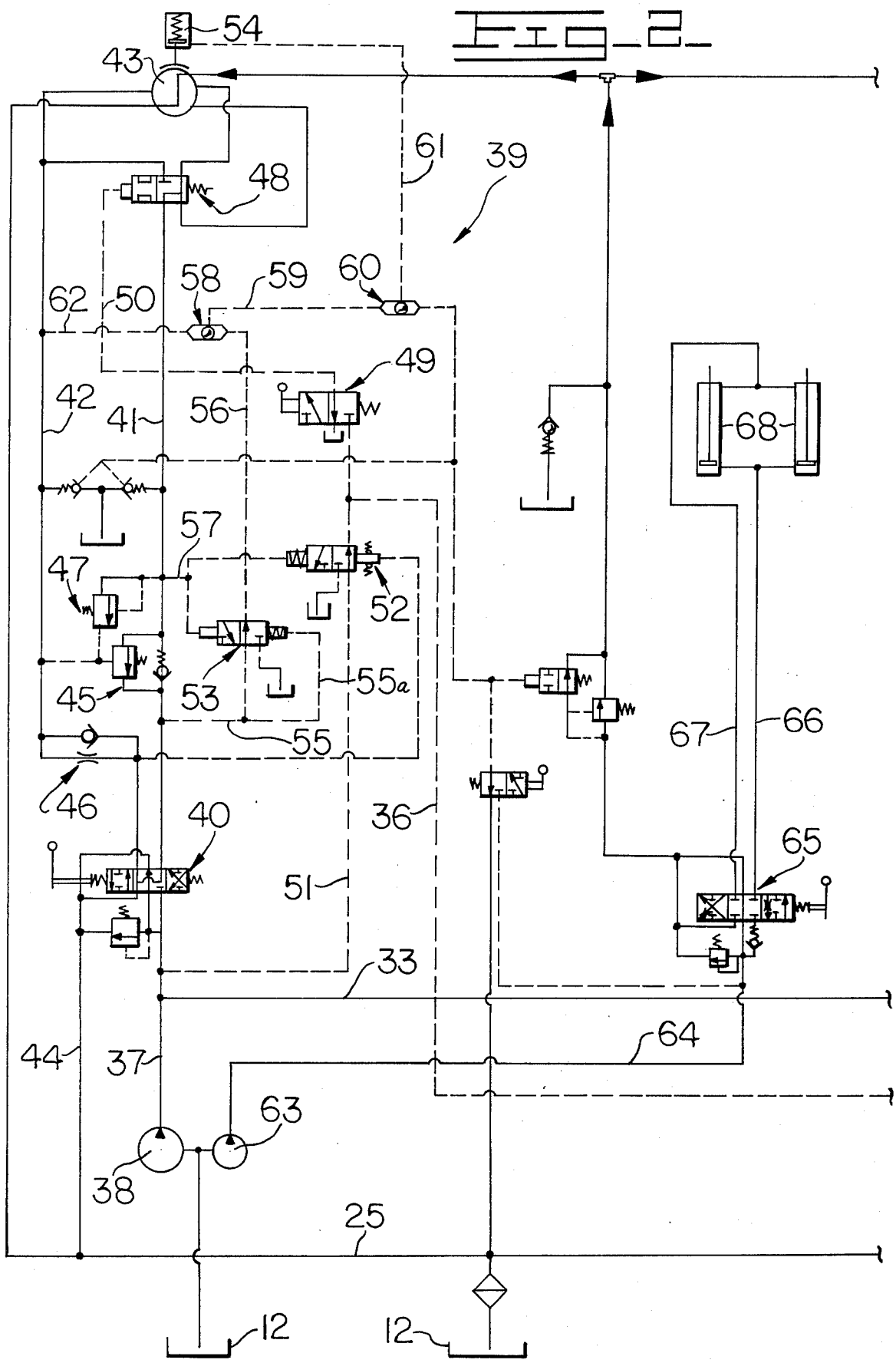
FIG. 2 is a schematic layout of the hoist and counterweight circuits for the system of FIG. 1.

The hoist control circuit is basically the same as the boom control circuit with a few additional refinements. The hoist control circuit illustrated in FIG. 2 comprises a main supply pump 38 supplying fluid by means of a main supply line 37 to a directional control valve 40 which is operative to direct fluid by either one of main motor control lines 41 or 42 for operation of a reversible radial piston hoist motor 43. The directional control valve 40 is operative in a neutral position as shown to permit fluid to flow therethrough and by way of a return line 44 to the sump 12 by way of a return line 25. The valve is also operative in either one of extreme positions to direct fluid by way of either one of the main control lines 41 or 42 to operate motor 43 while at the same time venting the other motor control line by way of passage or line 44 to the sump. Each of the main motor control lines 41 and 42 includes, respectively, a check and bypass valve assembly 45 and a check and restrictor assembly 46 operating in the same manner as in the boom control circuit. A damping valve 47 is also provided in the control line 41 to dampen pressure spikes which may occur therein.

A pilot-operated speed-control valve 48 is operative to control the fluid from line 41 to direct it to either part of or all of the pistons or cylinders of motor 43 for low- or high-speed operation thereof. A speed selector valve 49 is operative to direct pilot fluid by way of the pilot line 50 for operation of the valve 48. The pilot fluid for this operation is communicated to valve 59 by way of pilot line 51 which obtains the pressurized fluid from main pressure supply line 37. The supply of pilot fluid to the speed selector valve 49 is controlled by a speed override valve 52 which is responsive to an overload on motor 43 to vent the pilot supply fluid to tank or sump or permit automatic shifting of valve 48 back to a low-speed, high-torque operation. This speed override control valve assembly and its function is more fully described in copending application Ser. No. 554,255 filed simultaneously herewith and entitled SPEED OVERRIDE CONTROL FOR HYDRAULIC MOTORS and assigned to the assignee hereof.

A load control valve 53 is operative to prevent premature operation or release of brakes 54 of motor 43 under certain conditions. This is accomplished by controlling the communication of pilot fluid tapped by line 55 from motor control line 41 and supplied by way of valve 53 and conduit means 56 to the brake 54.

The load control valve 53 is responsive to differential pressure between line 55A below check valve assembly 45 and line 57 above the check valve assembly 45 to assume its control position. This arrangement is such that pressure below check valve assembly 45 must increase to substantially equal that of the pressure above the check valve in order for the valve 53 to shift to its open communicating position as shown to permit pilot fluid to be communicated to line 56 where it is then communicated to release brakes 54. The pilot fluid communicated by way of line 56 comunicates with a shuttle valve 58 to a line 59 and by way of a second shuttle valve 60 to line 61 for communication with the brake assembly 54. A pilot line 62 communicates pilot fluid from motor control line 42 by way of shuttle valve 58 and lines 59 and 62 to the brake assembly 54. Thus, when motor control line 42 is pressurized, pilot fluid communicates from line 62 by line 61 to release brake 54. When line 41 is pressurized, pilot fluid communicates by line 55 through load control valve 53, shuttle valve 58 and the remainder of the circuit to brake assembly 54 for releasing the brake to permit operation of the motor 43.

When the speed override control valve 52 is in the position shown, pilot fluid is available to valve 49 for shifting valve 48 to the high-speed position. Fluid is also available by way of pilot line 36 to the boom control circuit and pilot control valve 34 for shifting the diverter valve 18 for directing the fluid from that circuit to the hoist circuit of FIG. 2 for further high-speed operation of the motor 43. Should the motor 43 encounter a high load condition such that speed override control valve 52 is shifted to its vent position such that pilot fluid is no longer available to valve 49, the valve 48 will shift to the low-speed position for low-speed operation of the motor 43. Similarly, pilot fluid is no longer available by way of line 36 to pilot control valve 34 for operation of the diverter valve 18. The diverter valve 18 then automatically shifts to its illustrated position to cut off the flow of fluid from the pump 11 to supply line 33 for the hoist circuit.

From the above description it is seen that the overall system includes a first circuit for operation of the boom and a second circuit for operation of the hoist, with means for diverting fluid from the boom circuit to the hoist circuit for high-speed operation of the hoist under certain load conditions. The system includes speed or load override control means responsive to load on the hoist motor for shifting the hoist motor to low-speed operation and simultaneously therewith cutting off the diversion of fluid from the boom circuit to the hoist circuit.

The overall system also includes a circuit for control of the counterweights and/or outriggers of the vehicle. This system includes a pump 63 which supplies fluid by way of a supply line 64 to a directional control valve 65 which is operative to direct fluid by way of either one of motor control lines 66 or 67 for extension or retraction of motors 68 which are operative to extend or retract the counterweight as required.

While the present invention has been described by means of a single embodiment, it is to be understood that numerous changes and modifications may be made therein without departing from the spirit and scope of the invention as defined in the appended claims.

What is claimed is:

1. A hydraulic system for a pipelayer having a boom and a winch powered by hydraulic motors comprising:

a boom control circuit including a first hydraulic motor, a first source of pressurized fluid and first control valve means operative for selectively directing fluid from said source for operation of said first motor;

a hoist control circuit including a second hydraulic motor, a second source of pressurized fluid and second control valve means for selectively directing pressurized fluid from said second source for operation of said second motor; and control means including first pressure-responsive control means responsive to a first predetermined pressure to permit combining of fluid from said first source with fluid from said second source for high-speed operation of said second hydraulic motor, said control means including second pressure-responsive control means responsive to a second predetermined pressure to prevent said combining of fluid, wherein said second pressure-responsive control means includes a speed override control valve responsive to said second predetermined pressure to vent said first predetermined pressure.

2. A hydraulic system for a pipelayer having a boom and a winch powered by hydraulic motors, comprising:

a boom control circuit including a first hydraulic motor, a first source of pressurized fluid and first control valve means operative for selectively directing fluid from said source for operation of said first motor;

a hoist control circuit including a second hydraulic motor, a second source of pressurized fluid and second control valve means for selectively directing pressurized fluid from said second source for operation of said second motor; and control means including first pressure-responsive control means responsive to a first predetermined pressure to permit combining of fluid from said first source with fluid from said second source for high-speed operation of said second hydraulic motor, said control means including second pressure-responsive control means responsive to a second predetermined pressure to prevent said combining of fluid, wherein said first pressure-responsive means is a diverter valve disposed between said first source and said first control valve for diverting the fluid dfrom said first source to said second circuit, and wherein said second pressure responsive control means includes a speed override valve responsive to said second predetermined pressure to vent said first predetermined pressure.

3. The hydraulic system of claim 2 wherein said second predetermined pressure is dependent upon the load on said second hydraulic motor.

4. The hydraulic system of claim 3 wherein said first and said second hydraulic motors are rotary hydraulic motors.

5. The hydraulic control system of claim 1 wherein said second predetermined pressure is dependent upon the load on said second hydraulic motor.

6. A hydraulic system for a pipelayer having a boom and a winch powered by hydraulic motors, comprising:

a boom control circuit including a first hydraulic motor, a first source of pressurized fluid and first control valve means operative for selectively directing fluid from said source for operation of said first motor;

a hoist control circuit including a second hydraulic motor, a second source of pressurized fluid and second control valve means for selectively directing pressurized fluid from said second source for operation of said second motor; and control means including first pressure-responsive control means responsive to a first predetermined pressure to permit combining of fluid from said first source with fluid from said second source for high-speed operation of said second hydraulic motor, said control means including second pressure-responsive control means responsive to a second predetermined pressure to prevent said combining of fluid, wherein said second predetermined pressure is dependent upon the load on said second hydraulic motor, and said second pressure-responsive control means includes a speed override valve responsive to said second predetermined pressure to vent said first predetermined pressure.

7. A hydraulic system for a pipelayer having a boom and a winch powered by hydraulic motors, comprising:

a boom control circuit including a first hydraulic motor, a first source of pressurized fluid and first control valve means operative for selectively directing fluid from said source for operation of said first motor;

a hoist control circuit including a second hydraulic motor, a second source of pressurized fluid and second control valve means for selectively directing pressurized fluid from said second source for operation of said second motor; and control means including first pressure-responsive control means responsive to a first predetermined pressure to permit combining of fluid from said first source with fluid from said second source for high-speed operation of said second hydraulic motor, said control means including second pressure-responsive control means responsive to a second predetermined pressure to prevent said combining of fluid, wherein said first and said second hydraulic motors are rotary hydraulic motors, said second predetermined pressure is dependent upon the load on said second hydraulic motor, and wherein said second pressure-responsive control means includes a speed override control valve responsive to said second predetermined pressure to vent said first predetermined pressure.

8. The hydraulic system of claim 7 wherein said first pressure-responsive means is a diverter valve disposed between said first source and said first control valve for diverting the fluid from said first source to said second circuit.

* * * * *